United States Patent [19]

Huhmann

[11] Patent Number: 5,062,177

[45] Date of Patent: Nov. 5, 1991

[54] BRUSH HEAD FOR DEBURRING AND BRUSHING MACHINES

[75] Inventor: Reinhard Huhmann, Gummersbach, Fed. Rep. of Germany

[73] Assignee: RSA Entgrat-Technik Rainer Schmidt, Fed. Rep. of Germany

[21] Appl. No.: 459,772

[22] PCT Filed: Jun. 3, 1988

[86] PCT No.: PCT/DE88/00325

§ 371 Date: Feb. 16, 1990

§ 102(e) Date: Feb. 16, 1990

[87] PCT Pub. No.: WO89/00480

PCT Pub. Date: Jan. 26, 1989

[30] Foreign Application Priority Data

Jul. 17, 1987 [DE] Fed. Rep. of Germany ..... 3723602

[51] Int. Cl.[5] ..... A47L 15/00

[52] U.S. Cl. ..... 15/88.2; 15/49.1

[58] Field of Search ..... 15/21.1, 88.2, 49.1, 15/50.1, 77

[56] References Cited

U.S. PATENT DOCUMENTS

| | | | |
|---|---|---|---|
| 2,668,968 | 2/1954 | Dobrowolski | 15/49.1 X |
| 2,950,494 | 8/1960 | Dickson | 15/50.1 |
| 3,163,031 | 12/1964 | Kestell | 15/169 UX |
| 3,421,168 | 1/1969 | Bartel | 15/21.1 |
| 3,678,529 | 7/1972 | Woods et al. | 15/169 X |
| 4,097,950 | 6/1978 | Satterfield | 15/49.1 |
| 4,150,456 | 4/1979 | Alvarez et al. | 15/49.1 |
| 4,319,434 | 3/1982 | Brejcha | 15/49.1 X |
| 4,676,339 | 6/1987 | Osborn | 15/21.1 X |
| 4,879,966 | 12/1989 | Gourronc | 15/49.1 X |

FOREIGN PATENT DOCUMENTS

| | | |
|---|---|---|
| 2325025 | 12/1974 | Fed. Rep. of Germany . |
| 7807217 | 7/1978 | Fed. Rep. of Germany . |
| 145453 | 12/1980 | Fed. Rep. of Germany . |
| 1450774 | 7/1966 | France . |
| 2584011 | 1/1987 | France . |
| 652065 | 10/1985 | Switzerland . |

*Primary Examiner*—Paul T. Sewell
*Assistant Examiner*—BethAnne C. Cicconi
*Attorney, Agent, or Firm*—Jones, Askew & Lunsford

[57] ABSTRACT

With a brush head (4) for deburring and brushing machines, a base plate (41) is connected to the driveshaft (2) of the machine to the moment of rotation is transmitted and several fingerlike brushes (5) arranged coaxially with driveshaft (2) are held in this base plate. Parallel with the axially movable base plate (41) there is a guide plate (42) on the same working shaft (43) through which brushes (5) project with their free length.

In order to assure uniform wear on the brushes during operation, brushes (5) are mounted in base plate (41) so they can rotate, and they are driven at a rotational speed whose ratio to the rotational speed of brush head (4) amounts to a maximum of about 1:50.

7 Claims, 1 Drawing Sheet

BRUSH HEAD FOR DEBURRING AND BRUSHING MACHINES

This invention concerns a brush head for deburring and brushing machines with a base plate attached to the working shaft of the machine so it turns with it, and several fingerlike brushes are held replaceably in the base plate parallel to the axis of rotation and with a guide plate mounted parallel to the base plate so it is adjustable relative to the latter in axial direction and the brushes pass through the guide plate.

Such a brush head operated at high speeds of, for example, 1500 rpm is known from German Utility Patent 7,807,217. With this brush head, the fingerlike brushes which may consist, for example, of wire bristles, abrasive nylon or other materials are held so they are axially parallel with a working shaft of the machine on a base plate mounted on the shaft. These brushes project through a guide plate. The two plates are adjustable relative to each other in the axial direction of the working shaft. The guide plate prevents the individual bristles, etc. from escaping during the rotation of the brush head, which rotates at a high speed. The free brush length can be varied by moving the base plate, e.g., when a "soft brushing effect" is desired. Especially in operation of such a brush head with a relatively large free brush length and a high rotational speed, the bristles on the trailing end of the working direction can bulge out because the rear bristles on the trailing end are no longer supported by bristles behind them. This results in different machining angles between the front and rear bristles. This difference in machining angle, which occurs during prolonged use of the brush head—depending on the bristle material, the free bristle length and the pressure applied—results in different machining qualities.

East German Patent 145,453 describes a brush head for a deburring or brushing machine whereby several brushes like paintbrushes mounted so they can rotate on a base body of a gear casing are each driven individually at a high rotational speed. The base body of the gear casing executes a slow rotational motion while the brushes are driven at a high speed. Such a brush head should be used preferably for deburring recessed workpiece contours. Since the brushes that are designed like paintbrushes are not supported at the sides, the individual bristles spread apart greatly due to the centrifugal forces that occur, so the tips of the bristles strike the surface to be deburred only to a limited extent. A brush head of this type is, therefore, unsuitable for deburring large areas and edges. The deburring results must necessarily be uneven and inadequate.

The purpose of this invention is to propose a brush head of the type defined initially, whereby the brushes rotate about a central axis at a high peripheral velocity and whereby the fingerlike brushes wear uniformly over their end faces in order to keep the machining quality of such a brush head constant over the entire useful length of the individual brushes.

The problem on which this invention is based is solved by a brush head of the type described initially, characterized in that the brushes are mounted so they can rotate in the base plate and they are driven with a speed whose maximum ratio relative to the speed of the brush head is about 1:50. The additional rotational motion of the brushes according to this invention is not a cutting motion. The actual cutting velocity is achieved by the rotational motion of the brush head. Due to the additional superimposed rotation of the brushes rotating at a very low rotational speed, e.g., 1–2 rpm, about their own axis it is possible to assure that the individual bristles of the fingerlike brushes will wear uniformly during operation of the brush head because the bristles of a brush assume different positions during operation relative to the workpiece being treated. There is no bowing of the bristles. The machining angle remains constant within the brush. Uniform wear of the brushes assures uniform deburring or brush treatment with a uniform surface quality accordingly. In addition, the lifetime of the brushes is greatly increased.

In comparison with a brush head known from East German Patent 145,453, the cutting speed necessary for deburring is achieved with the brush head according to this invention by the brushes rotating at a high rotational speed at a distance from the axis of rotation and the brushes are supported at the side and, therefore, cannot escape toward the outside to any great extent under centrifugal force. The superimposed slow rotational motion of the individual brushes assures that the bristles of a brush will assume different positions relative to the workpiece to be treated during the operation of the bristles of a brush and thus they will all wear uniformly.

According to a preferred version of this invention, the brush head is characterized in that preferably an even number of brushes are interconnected so they all rotate together and are arranged with some distance between them on the base plate concentrically on a common partial circle where they are distributed uniformly and at least one of these brushes is driven. The brush can be driven indirectly by way of the driveshaft of the machine and a gearwheel can be placed on the driveshaft so it rotates with the driveshaft and is connected to a countershaft of the driven brush in such a way that the moment of rotation is transmitted. The even-numbered arrangement of brushes prevents opposing movements of neighboring brushes, so the bristles of neighboring brushes cannot become entangled.

This invention will be illustrated further below on the basis of a practical example as shown in the figures, namely:

DESCRIPTION OF PREFERRED EMBODIMENT

Figure 2:
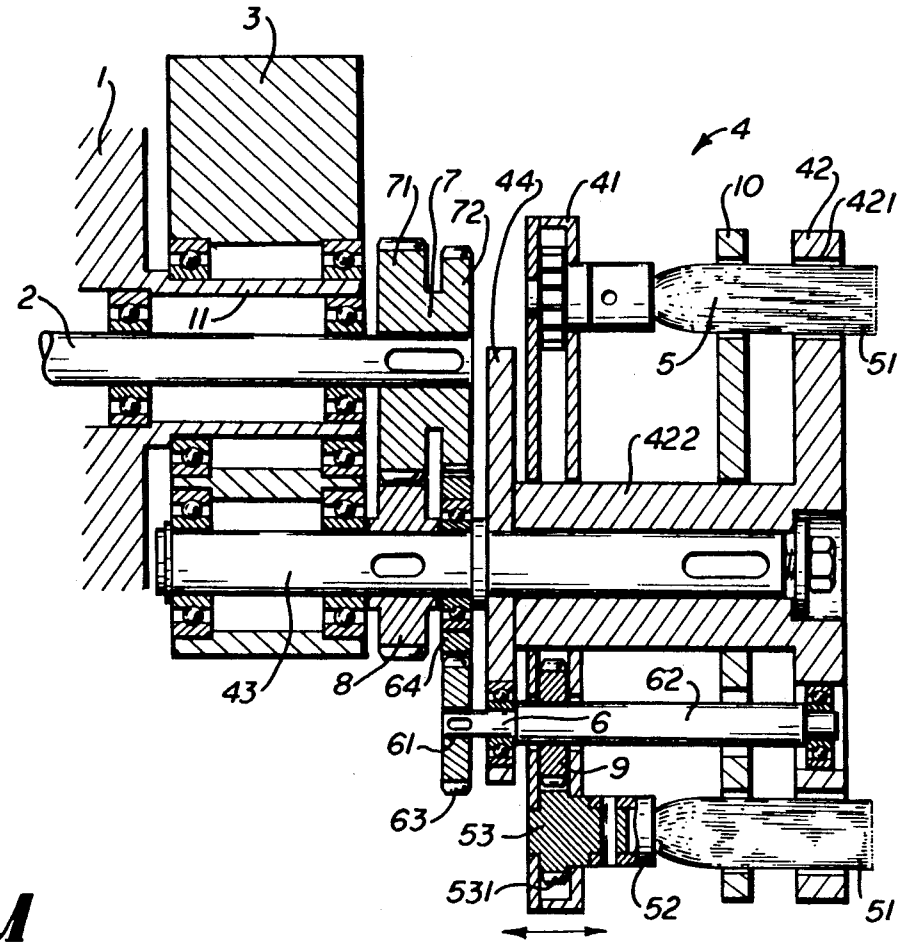
FIG. 1 shows the front view of a brush head of a deburring or brushing machine and FIG. 2 shows a section along line I—I in FIG. 1.
Figure 1:
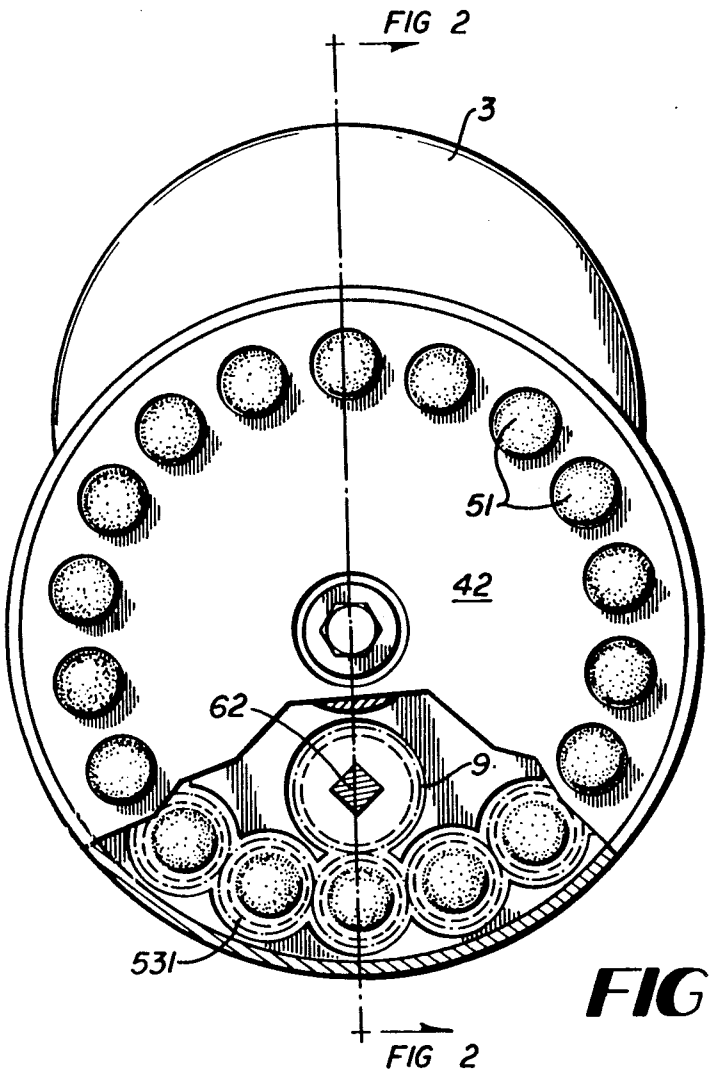

The driveshaft (2) for the brush head, which is indicated on the whole as (4), is driven by a motor (not shown) and projects out of the machine housing labelled as (1). In addition to rotating about driveshaft (2), the brush head executes a planetary motion about housing support (11). An eccentric housing (3) sits on housing support (11), which surrounds driveshaft (2), in such a way that the eccentric housing can rotate. Brush head (4) is mounted with working shaft (43) in this eccentric housing (3). A gearwheel (7) is placed on the end of driveshaft (2) so it turns with it, and with its toothed wheel rim (71) it engages gearwheel (8) on working shaft (43).

Brush head (4) is placed on the outer end of working shaft (43) and consists of a base plate (41) on which a preferably even number of fingerlike brushes (5) are arranged coaxially with working shaft (43), so they are distributed evenly on a concentric common partial circle with a small distance between them. A guide plate (42) is provided parallel to base plate (41) on working shaft (43), so the brushes (5) pass through the guide plates and project outward with an adjustable free length. Base plate (41) is placed on a pin (422) of guide plate (42), so it can be moved in the axial direction of the working shaft (43). Between base plate (41) and guide plate (42) with the bores (421) for engagement of brushes (5), a supporting plate (10) is movably mounted so that during operation it prevents the bristles (51) of brushes (5) from bulging outward due to the centrifugal forces so there is the danger they might pull out of boreholes (421).

The individual fingerlike brushes (5) have a sleeve-shaped end part (52) with which they are removably attached and secured on the rotationally symmetrical holding part (53) in base plate (41). These holding parts (53) are in turn mounted so they can rotate about the longitudinal axis of brush (5) in base plate (41). For example, they may each have a toothed wheel rim (531) on the outside with which they are interconnected, so they rotate together.

The driving pinion (9) acts on at least one of the toothed wheel rims (531) of a holding part (53). This driving pinion sits movably on the corresponding guide section (62) of a countershaft (6) that drives all the brushes (5) so the pinion can move axially and rotates with the shaft. This countershaft (6) is mounted in guide plate (42) on one end and on a bearing plate (44) on the other end, which is held parallel with base plate (41) at the end of pin (422). The bearing shaft section (61) of countershaft (6) passes through this bearing plate (44). A gearwheel (63) sits on this section of the bearing shaft and is connected by an intermediate wheel (64) with a second toothed wheel rim (72) on gearwheel (7) on driveshaft (2) with a different diameter than toothed wheel rim (71).

With a suitable matching of gears in this way the rotational motion of brush head (4) about the axle of driveshaft (43) and the drive of the individual brushes (5) about their own individual axes is achieved by means of driveshaft (2). Brush head (4) is driven, for example, at a speed of 1500 rpm, but the individual brushes (5) are driven at a much lower speed of a few rpm. The ratio of the speed of the driven brushes (5) to the speed of the brush head (4) should amount to a maximum of about 1:50.

With a brush head arranged as described here, it is possible to execute a planetary motion, preferably with a separate planetary drive, simultaneously during the rotation of brush head (4) about its own axis in which case eccentric casing (3) is driven. Instead of the gears shown here for the sake of example, other transmission devices are also possible, e.g., enveloping drives.

I claim:

1. Brush head (4) for deburring and brushing machines, comprising:

a base plate (41) rotatingly connected to a working shaft (43), several fingerlike brushes (5) held in said base plate (41), said brushes (5) being arranged parallel to said working shaft (43) and on a circle concentric to said working shaft (43);

means driving said base plate (41) by a planetary gearing (7,8) for autorotation about said working shaft (43), and for a planetary motion on a circular orbit around a drive shaft (2) of the machine;

each fingerlike brush (5) being rotatably associated with said base plate (41); and means driving the fingerlike brushes with a rotational speed whose maximum ratio relative to the speed of autorotation of said base plate (41) is about 1:50.

2. Brush head according to claim 1, further comprising an even number of the individual brushes (5) distributed uniformly on the circle concentric with the working shaft (43) and arranged with a distance between them and each individual brush being connected to a corresponding gearwheel (53,531) mounted in a base plate (41) whereby gearwheels (53,531) of the adjacent individual brushes (5) are in a rotating mutual drive connection, and means driving at least one of the gearwheels (53,531) so that all the individual brushes are driven in response to the mutual drive connection between adjacent individual brushes.

3. Brush head according to claim 1, wherein the rotation of the individual brushes (5) takes place indirectly in response to rotation of the driveshaft (2).

4. Brush head according to claim 3, characterized in that the drive shaft (2) has a gearwheel (7) which is in a torque-transmitting engagement with a countershaft (6) of the driven individual brushes (5).

5. Brush head according to claim 1, wherein the individual brushes (5) are held interchangeably in the base plate (41).

6. Brush head according to claim 1, further comprising a guide plate (42) arranged parallel to base plate (41) on driveshaft (43) with boreholes (421) through which the individual brushes (5) pass, where the distance between the base plate (41) and the guide plate (42) is adjustable in the axial direction such that the free length of the individual brushes (5) projecting outward after guide plate (42) can be adjusted.

7. Brush head according to claim 6, further comprising a supporting plate (10) parallel to and between base plate (41) and guide plate (42) and mounted so that the supporting plate can move axially relative to the base plate, the supporting plate having openings through which the individual brushes (5) can pass.

* * * * *

UNITED STATES PATENT AND TRADEMARK OFFICE

CERTIFICATE OF CORRECTION

PATENT NO. : 5,062,177

DATED : November 5, 1991

INVENTOR(S) : Reinhard Huhmann

It is certified that error appears in the above-identified patent and that said Letters Patent is hereby corrected as shown below:

In column 4, line 23, add a comma (,) immediately after "them".

Signed and Sealed this

Second Day of March, 1993

*Attest:*

STEPHEN G. KUNIN

*Attesting Officer*

*Acting Commissioner of Patents and Trademarks*